US010076847B2

(12) United States Patent
McClure et al.

(10) Patent No.: US 10,076,847 B2
(45) Date of Patent: Sep. 18, 2018

(54) APPARATUS FOR NOTCHING LAPPED ROOF PANELS

(71) Applicant: BLUESCOPE BUILDINGS, NORTH AMERICA, INC., Kansas City, MO (US)

(72) Inventors: Richard McClure, Basehor, KS (US); Gregory E. Effland, Lee's Summit, MO (US)

(73) Assignee: Bluescope Buildings North America, Inc., Kansas City, MO (US)

( * ) Notice: Subject to any disclaimer, the term of this patent is extended or adjusted under 35 U.S.C. 154(b) by 158 days.

(21) Appl. No.: 15/154,548

(22) Filed: May 13, 2016

(65) Prior Publication Data

US 2017/0326745 A1 Nov. 16, 2017

(51) Int. Cl.

*B26B 27/00* (2006.01)
*B21D 28/14* (2006.01)
*B21D 39/02* (2006.01)

(52) U.S. Cl.

CPC ..... *B26B 27/00* (2013.01); *B21D 39/021* (2013.01)

(58) Field of Classification Search

CPC ..... B26B 27/00; B21D 28/14
USPC ..... 30/229, 134, 244, 245, 252, 254, 239, 30/237
See application file for complete search history.

(56) References Cited

U.S. PATENT DOCUMENTS

| | | | | |
|---|---|---|---|---|
| 1,679,572 | A | 8/1928 | Hayden | |
| 2,595,841 | A * | 5/1952 | Glick | B23D 23/02 30/229 |
| 2,653,663 | A | 9/1953 | Maxant | |
| 3,091,853 | A | 6/1963 | Polayes | |
| 4,446,623 | A | 5/1984 | Stubbersfield et al. | |
| 4,610,086 | A * | 9/1986 | Mastroianni | B23D 21/02 30/135 |
| 5,483,746 | A * | 1/1996 | Beyers | B23D 27/02 30/229 |
| 6,185,824 | B1 | 2/2001 | McClure et al. | |
| 6,438,924 | B1 | 8/2002 | Clover | |
| 6,840,078 | B1 | 1/2005 | Clover | |
| 6,959,633 | B2 | 11/2005 | Brady | |
| 7,549,362 | B2 * | 6/2009 | Hanks | B23D 27/02 30/272.1 |
| 7,637,017 | B2 | 12/2009 | Retterer et al. | |

* cited by examiner

*Primary Examiner* — Omar Flores Sanchez
(74) *Attorney, Agent, or Firm* — Lathrop Gage L.L.P.

(57) ABSTRACT

A tool for field notching metal roof panels to allow the panels to properly nest within an end lap condition, the notching tool operable between an open and closed position. The notching tool is comprised of two mechanism assemblies, each assembly comprised of two handles with the proximal end of each handle connected to either a first jaw body or a second jaw body and the distal end of each handle connected to a handle separation member that spans the distance to the opposing mechanism assembly. At the distal end of each of the jaw bodies a pair of dies, male and female, that span the distance between the first and second mechanism assemblies. The male and female dies are used for severing excess material from the roof panel edges.

12 Claims, 7 Drawing Sheets

APPARATUS FOR NOTCHING LAPPED ROOF PANELS

TECHNICAL FIELD

This disclosure relates generally to the field of tooling to facilitate the installation of standing seam roofs on pre-engineered building systems. More specifically, the disclosure relates to the field of specialized tooling to quickly and easily create notches in metal roof panels to allow panels to properly nest within a lap condition.

BACKGROUND

Metal roofs on pre-engineered building systems include a deck formed of a plurality of panels connected together and to the building structural elements in a non-penetrating manner Clip units and edge crimping attach these roof panels together and to the building. When metal panel roofs are installed on buildings there are overlap conditions to create a watertight seal. For example, when the roof is sufficiently wide and there are multiple panels required to cover the distance from the roof ridge to the eave, the panels will be overlapped. Specifically, the upslope panel, closest to the roof ridge, is laid atop and overlaps the downslope panel by several inches. The upslope and downslope panels at their longitudinal edges are then secured to one another with attachment clips. Illustrative of the overlapping roof panel concept is that found in a standing seam roof system. A standing seam roof is a metal roof that fastens to a structure without holes or penetrations.

A standing seam roof acts like a single steel membrane to protect the building. The roof is fastened to the structure using a mechanical seaming tool known as a "seamer." The seamer tool bends the lateral metal ribs of the roof panel, forms the final shape and connects the roof panels to the structure without penetrating the roof. A structural standing seam roof panel system meets performance goals by being constructed with a raised portion where the lateral edges of the two panels meet, enhancing overall weather resistance. The lateral edges of the panels interlock in such a way that allows thermal expansion without damage to the roof structural components. The standing seam roof system relies upon the locking seam to assure complete weather-tightness and structural integrity. The standing seam of the roof system is machine formed on site with the seam as the roof system is installed, assuring a tight permanent seam.

At certain locations on the roof during installation there will be multiple overlaps of roofing panels. As discussed above, at the upslope and downslope panel overlap there will be two layers of panel that when wrapped in the double lock seam will form four wrapped layers. If the overlap from the laterally adjacent panel is included in the wrap this may create an undesirable configuration which can lead to a capillary action resulting in roof leaks. At present, when there is an overlap of excessive material, field notching has been completed with hand snips which is labor intensive, inaccurate and often impractical in certain roof configurations. Consequently, there is a need for a tool to quickly, and easily, remove excess material when there is an overlap condition that exceeds the limit of four layers in the seamed overlap.

The disclosed notching tool is capable of quickly and accurately removing excess material from a roof end lap condition. By simply sliding the area of the roof panel to be notched between the male and female dies of the tool and applying pressure to the handle components undesirable sheet metal can quickly be removed from the roof panel.

SUMMARY

The present disclosure details a tool for notching panels of a roof system to allow the roof panels to properly nest within a lap condition. Sometimes a portion of the lapped area of the panel must be notched so materials do not build up too many thicknesses thereby preventing the proper formation of a water tight seam.

The notching tool is comprised of two mechanism assemblies, each assembly is comprised of two handles with the proximal end of each handle connected to a jaw body and the distal end of each handle connected to a handle separation member that spans the distance to the opposing mechanism assembly. The jaw bodies are articulated through the use of major and minor rotation links at the proximal end of each handle and the jaw bodies rotate about a fulcrum formed into an inner side surface of one of the jaw bodies. The fulcrum extends into a slot or cutout in the opposing jaw body and the fulcrum is capable or rotating within the cutout. The separation distance between the jaw bodies is maintained by the use of link plates that span between and are secured to the first and second jaw bodies of each mechanism assembly. At the distal end of each of the jaw bodies, a male and female die span the distance between the first and second mechanism assemblies.

The male die spanning the distal end of the jaw bodies includes an overhang element. When pressure is applied to the handle separation members by the user of the tool, the force is transmitted along the handles to the proximal end of the jaw body. The proximal end of the first and second jaw bodies of both mechanism assemblies rotate away from one another due to the functionality of the major and minor rotation links. The proximal ends of the jaw bodies rotate about the fulcrum causing the distal ends of both jaw bodies of the first and second mechanism assemblies and the associated male and female dies to converge upon one another.

When the overlapping edge of a roof panel is positioned between the male and female dies and pressure is applied to the handle separation members the overhang element of the male die advances against the panel material. As the overhang element bites into the panel material, the overhang element severs the material from the panel thereby accomplishing the desired material removal.

BRIEF DESCRIPTION OF THE DRAWINGS

The foregoing and other features and advantages will be apparent from the more particular description of preferred embodiments, as illustrated in the accompanying drawings, in which like reference characters refer to the same parts throughout the different views. The drawings are not necessarily to scale; the sizes of elements may be exaggerated for clarity.

DETAILED DESCRIPTION

A pre-engineered building is a type of building that consists of several factory-built components or units that are assembled on-site to complete the unit. Pre-engineered buildings typically utilize roof framing members that span parallel to the building eave, and support the roof decking or sheeting. In order for metal roof panels to properly nest within an end lap condition a portion of the lapped area of the panel must be notched so that the roof seams do not include an excessive number of layers of wrapped material. Sometimes roof panel notching is accomplished in the factory where the roof panels are fabricated. But in most situations, notching the roof panels occurs on-site and the only way to notch a roof panel, prior to the disclosed notching tool, is to use hand snips, which are labor intensive, inaccurate and impractical in many situations.

Figure 1:
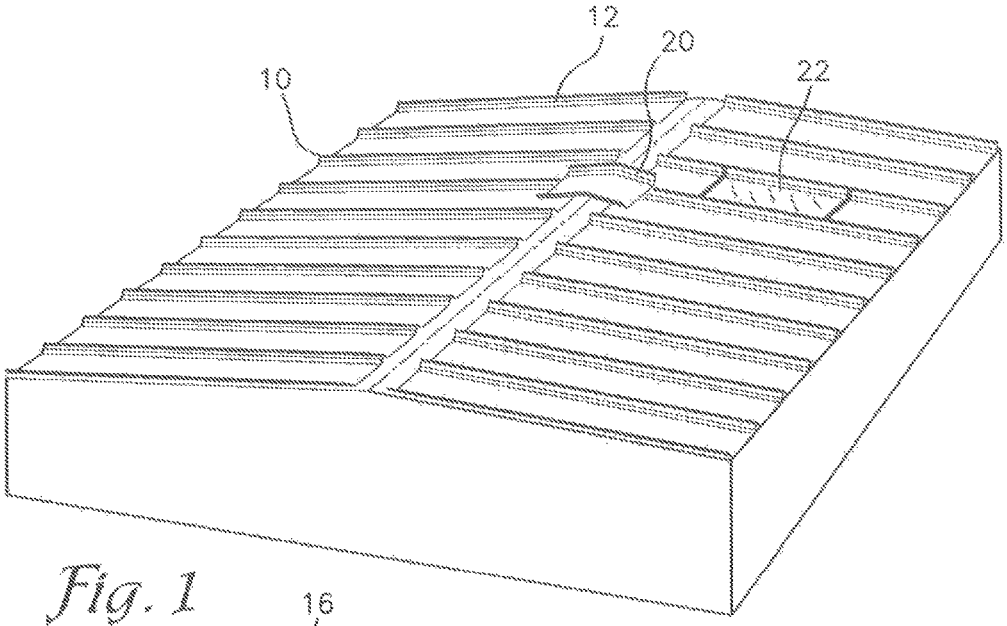
FIG. 1 is a perspective view of a building structure of a type for which metal roofing panels are installed.
Figure 2:
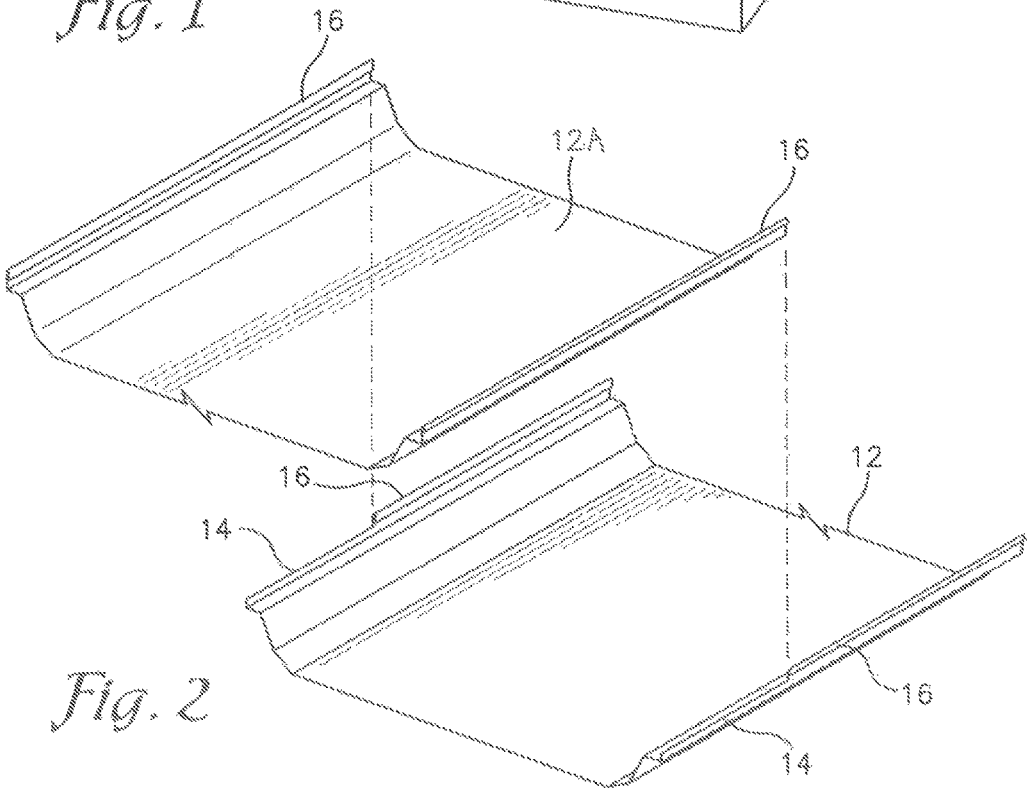
FIG. 2 is a perspective view of an embodiment of overlapping roof panels detailing the upslope and downslope panels and the desired location of the notch o the downslope panel.
Figure 3:
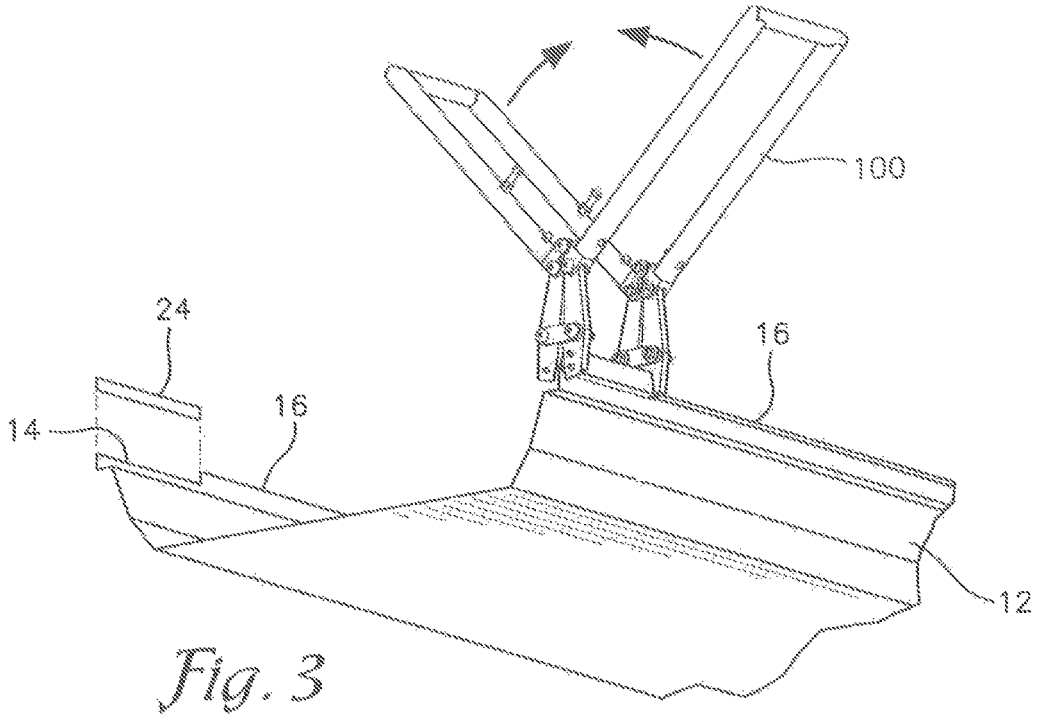
FIG. 3 a perspective view of the notching tool in position on a roof panel.
Figure 4:
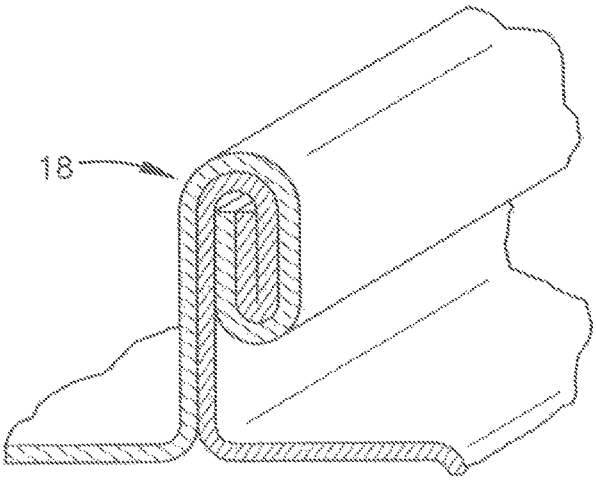
FIG. 4 a perspective view of an edge of a double lock roof seam detailing the four layers wrapped therein.

FIG. 1 details a pre-engineered building 10 with roof panels 12 in position atop the building 10. Roof panels 12 typically overlap one another at the longitudinal ends with about six inches of the longitudinal end of the downslope panel disposed beneath the upslope panel. FIG. 2 reveals the lower panel 12 with notches 14 at the lateral edges 16. The notch 14 is critical in that the process of interlocking laterally adjacent roof panels includes forming a seam 18, as shown at FIG. 4, on the panels 12 so the panels are interlocked in a manner that does not penetrate the roof by, for example, threaded fasteners securing the roof panels to the roof support structure. Threaded fasteners, even with elastic or rubberized washers installed, can cause leaks in the roof as water generally finds a way to seep past fasteners and enter the interior spaces of the structure. FIG. 3 reveals an exemplary application of the notching tool 100 in position on a roof panel 12.

As seen in FIG. 2, a standing seam roof panel 12 has a surface portion 12A and an upstanding rib 16 along each lateral edge thereof and each rib 16 is configured to mate with the corresponding rib of an adjacent panel having a substantially vertical upstanding member. As shown in FIG. 4, the seam 18, joining two laterally adjacent roof panels 12, is preferably formed using a device, known in the industry as a "seamer." The seamer bends the metal to form the final shape and connect the roof to the structure without penetrating the roof. The lateral edge ribs 16 of the adjacent panels 12 are folded, by the seamer, to form a double lock seam joint 18 as shown in FIG. 4. The double lock seam 18 includes four rolled layers of roof panel lateral edge ribs 16 when the laterally adjacent panels are formed into the rolled seam. If the notch 14 were not formed into the end of the overlapping top panel 12 then an excessive number of rolled layers would comprise the rolled roof panel and forming a seam with more layers than typically are found in a waterproof seam. Excessive layers, or panel ribs, in a seam may result in water intrusion through the seam due to capillary action drawing water through a seam that is not as tightly wrapped as a seam with a lesser number of layers. Consequently, there exists a need to notch roof panels and to remove excessive layers of the overlapping top and bottom panels to avoid the creation of a seam with six folded layers.

Figure 5:
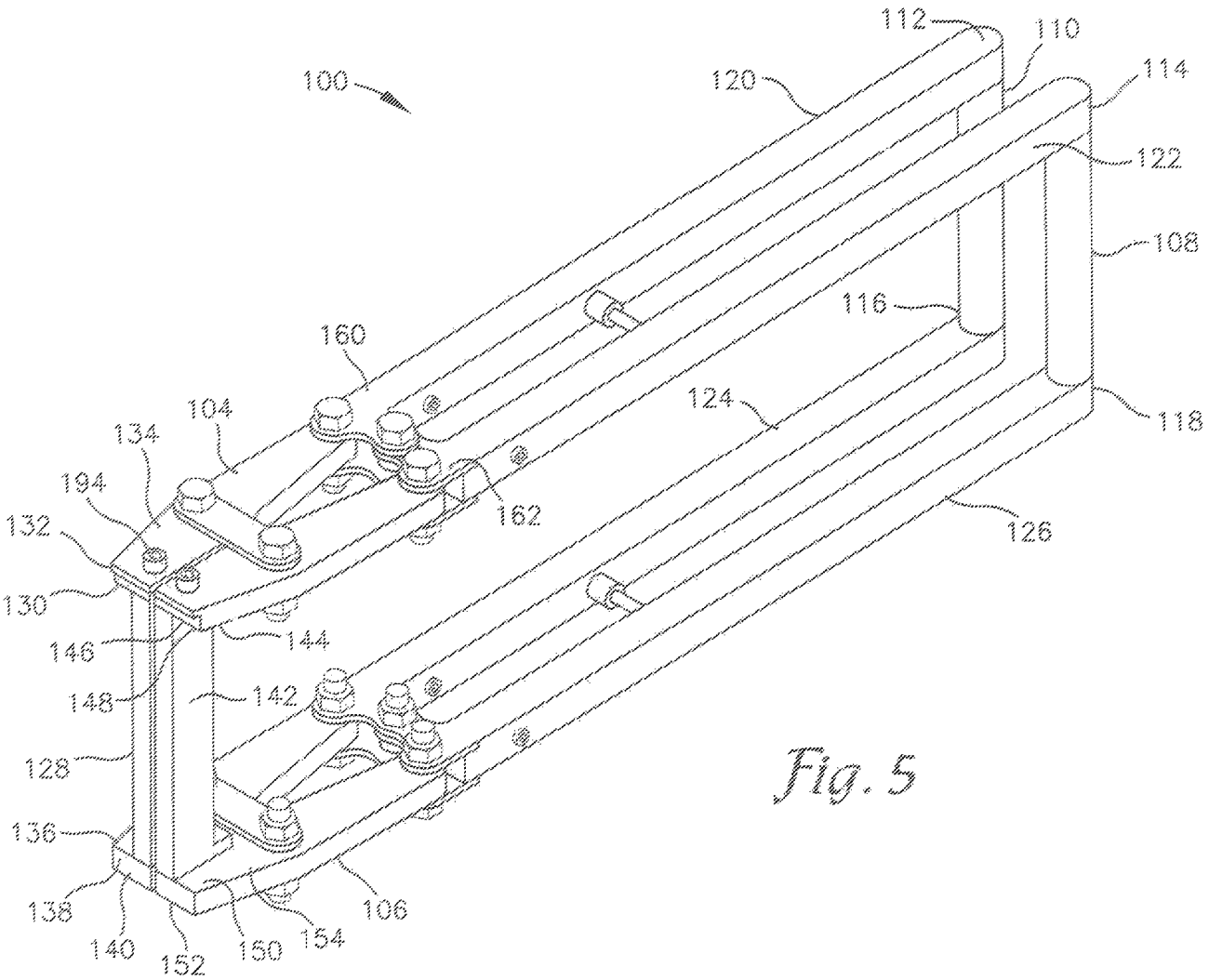
FIG. 5 a perspective view of an embodiment of the disclosed notching tool.
Figure 7:
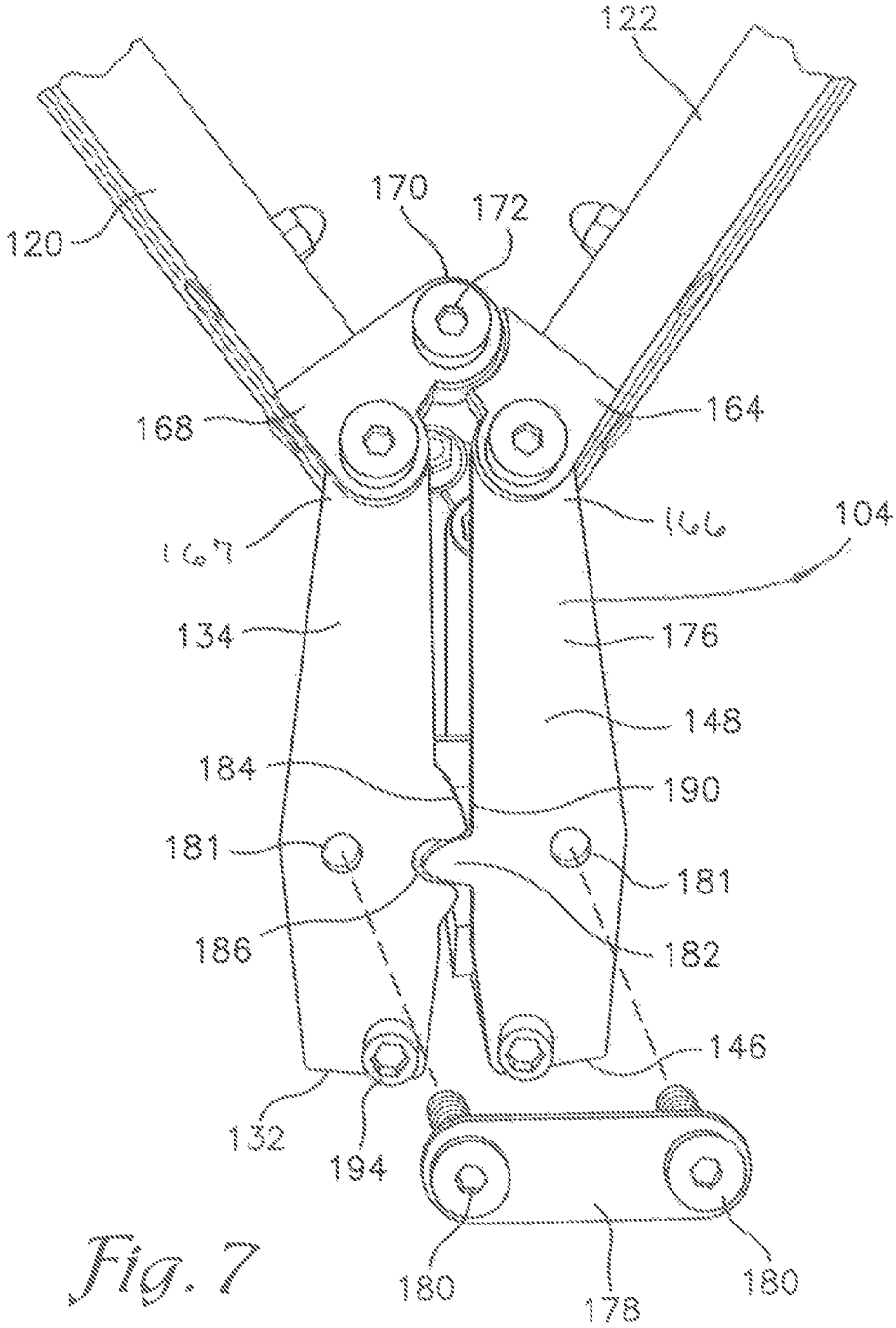
FIG. 7 a perspective view of an embodiment of the disclosed notching tool in the open position.

Similar challenges arise with the installation of ridge panels 20 and light panels 22 as shown in FIG. 1. These roof components also include overlapping metal panel edges that are formed into a seam and therefore notching is required to avoid excessive buildup of the layers. The notching tool 100, as shown in FIG. 5, facilitates the removal of overlapping roof panel material. The disclosed notching tool 100 is operable between a closed position as shown in FIG. 5 and an open position as seen in FIG. 7, wherein the open position allows for placement of the notching tool 100 onto the rib 16 of the roofing panel 12 and when in the closed position the notching tool severs the undesired material 24 from the roof panel 12.

FIG. 5 details the notching tool 100 comprised of a first mechanism assembly 104 separated from a second mechanism assembly 106 by two handle separation members 108, 110. The first and second mechanism assemblies include many similar structural elements; however, nominal differences may exist such as the location of holes for attaching the male and female dies. The handle separation members 108, 110 extend laterally between, and are secured to, the distal ends 112, 114, 116, 118 of both sets of handles 120, 122, 124, 126 of the first and second mechanism assemblies 104, 106. The handles and handle separation members are preferably fabricated from a high-strength steel to resist bending and fracture under heavy loads. The handles are preferably, but not limited to, a range of 15 to 24 inches in length with shorter handles facilitating easier packaging for transit of the tool between work sites as a shorter tool is not as unwieldy; however, longer handles provide the user with greater leverage and therefore require less strength to sever the material 24, as shown in FIG. 3, from the roof panel 12.

Figure 9:
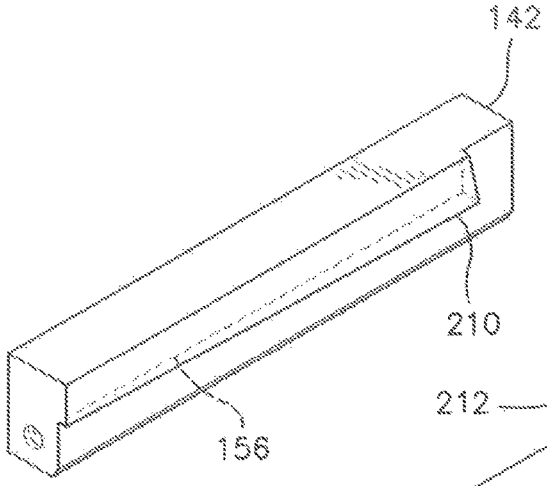
FIG. 9 a perspective view of an embodiment of the male die with an overhang element.
Figure 10:
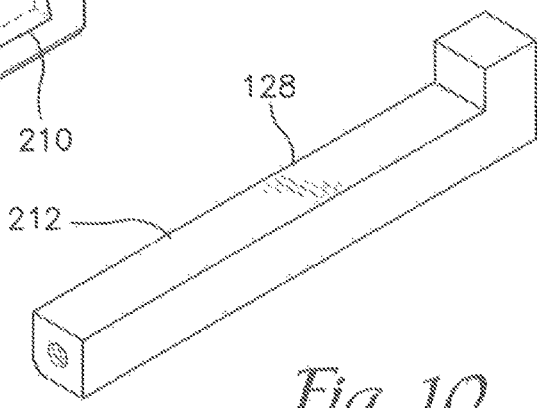
FIG. 10 is a perspective view of an embodiment of the female die of the disclosed notching tool.

Also seen in FIGS. 5 and 10 and separating the first and second mechanism assemblies 104, 106 by a distance roughly equivalent to the handle separation members 108, 110 is a female die 128 secured to and extending transversely from the inner facial surface 130 of the distal end 132 of the first jaw body 134 of the first mechanism assembly 104 to the inner facial surface 136 of the distal end 138 of the third jaw body 140 of the second mechanism assembly 106. In addition to the female die 128 a male die 142 is secured to and extending transversely from the inner facial surface 144 of the distal end 146 of the second jaw body 148 of the first mechanism assembly 104 to the inner facial surface 150 of the distal end 152 of the fourth jaw body 154 of the second mechanism assembly 106. As seen in FIG. 9, the male die 142 is configured with an overhang element 156 to sever the roof panel material 24 as the leading edge 210 of the overhang element 156 slides past the upper surface 212 female die 128 when the notching tool operator moves the handles 120, 122, 124, 126 to the closed position. The scissor action of the leading edge 210 of the overhang element 156 moving over the upper surface 212 of the female die 128 severs the metal rib 16 of the roof panel 12.

Figure 6:
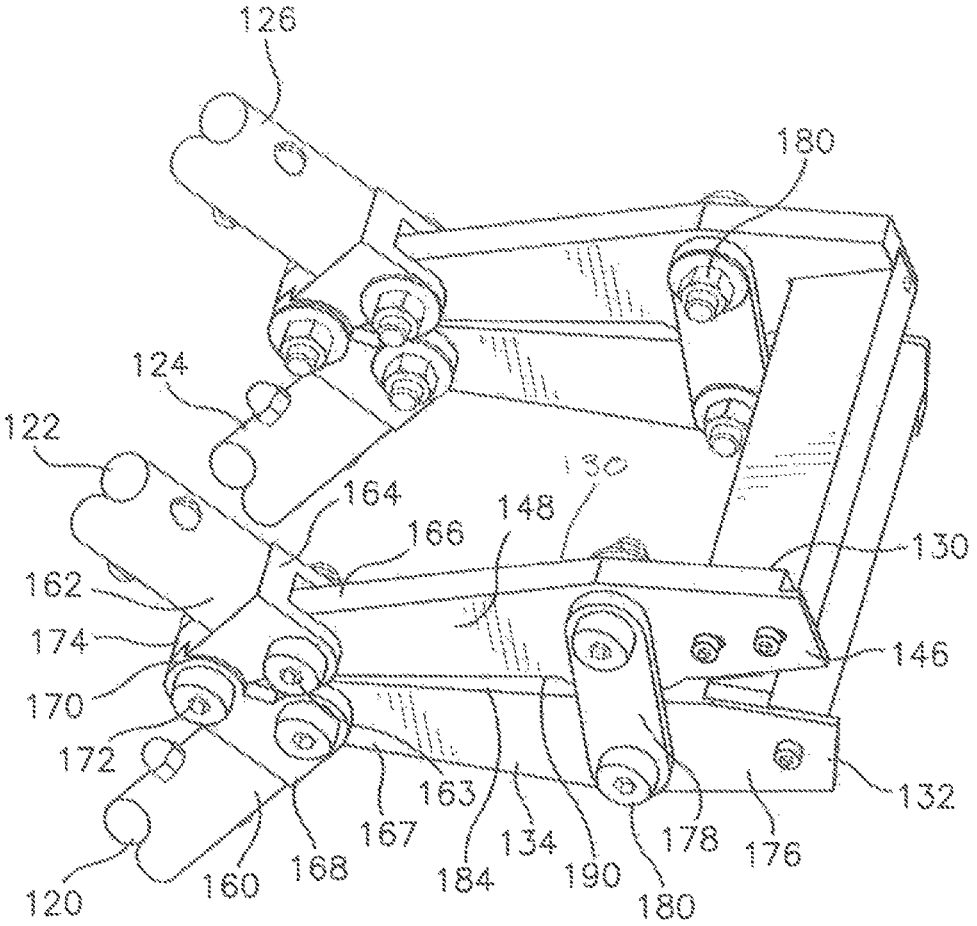
FIG. 6 a perspective view of an embodiment of the first and second mechanism assemblies of the disclosed notching tool.

FIG. 5 further reveals that the first mechanism assembly 104 is comprised of first and second outwardly extending handles 120, 122 each with a distal end 112, 114 and proximal ends 160, 162. FIG. 6 details that the proximal end 160 of the first outwardly extending handle 120 is secured to a major rotation link 168 that is rotatably secured to the proximal end 167 of the first jaw body 134 at a pivot point 163. The proximal end 162 of the second outwardly extending handle 122 is secured to a minor rotation link 164 that is rotatably secured to the proximal end 166 of the second jaw body 148 of the first mechanism assembly 104. The minor and major links 164, 168 are rotatably connected to one another at a hinge 170 that rotates about a pin 172 joining together the knuckles 174 of the links 164, 168. Identical, or very similar, links and hinges exist within the second mechanism assembly 106 and operate in an identical fashion as those found in the first mechanism assembly 104.

FIG. 6 further illustrates that the first and second jaw bodies 134, 148 of the first mechanism assembly 104 further comprise distal ends 132, 146 as well as inner 130 and outer 176 facial surfaces and inner side surfaces 184, 190. The first and second jaw bodies 134, 148 are joined together with at least one jaw link plate 178. The jaw link plate 178 is not so tightly secured to the jaw bodies 134, 148 with fasteners 180 passing through holes 181 in the jaw bodies as to inhibit movement of the jaw bodies relative to one another. The fasteners 180 pass through the jaw body holes 181 and then preferably through a second jaw link plate 178 and are ultimately secured in position with, for example a threaded nut, proximate the inner facial surfaces 130 of the jaw bodies.

FIG. 7 reveals that the jaw link plate 178 serves to anchor the jaw bodies 134, 148 to one another and to interact with the fulcrum 182 that is disposed directly beneath the jaw link plate 178 to provide the needed mechanical leverage for the notching tool 100 to sever the roof panel material 24. There are a total of four jaw link plates 178 spanning the inner and outer faces of the four jaw bodies of both mechanism assemblies 104, 106. The fulcrum 182 is an outward extension of the inner side surface 190 of the second jaw body 148 and is optionally configured for placement and rotation within a cutout 186 within the inner side surface 184 of the opposing jaw body 134 of the first mechanism assembly 104. A similar configuration of fulcrum, cutout and jaw link plates is present with the second mechanism assembly 106. In an alternative embodiment of the mechanism assemblies 104, 106 the fulcrum does not reside within a cutout of the opposing jaw body but is positioned against the inner side surface of the second jaw body.

As discussed above, and as shown in FIG. 5, separate female and male dies 128, 142 span between the first and second mechanism assemblies 104, 106 and are secured to the inner facial surfaces 130, 136, 144, 150 of the jaw bodies 104, 106 by threaded fasteners 194 that pass through the jaw bodies of the first and second mechanism assemblies 104, 106. The male die overhang element 156, as shown in FIG. 9, is configured to slide closely past the female die 128 when the notching tool operator moves the distal ends 112, 114, 116, 118 of the handles 120, 122, 124, 126 toward one another. The distance separating the male die overhang element 156 and the female die 128 when the notching tool 100 is in a closed position is preferably in the range of 0.005 to 0.02 inches as a close separation between the overhang element and the female die facilities the severing of the roofing panel material 24. The female and male dies 128, 142 and the overhang element 156 are preferably, but not exclusively, fabricated from hardened tool steel and the specific configuration of the male and female dies and overhang element may vary depending upon the specific depth and length of the notch required in the roof panel which is typically no greater than 24 gauge thickness. Additionally, the arrangement of the male and female dies may be reversed between the two mechanism assemblies without adversely impacting the operation of the notching tool.

Figure 8:
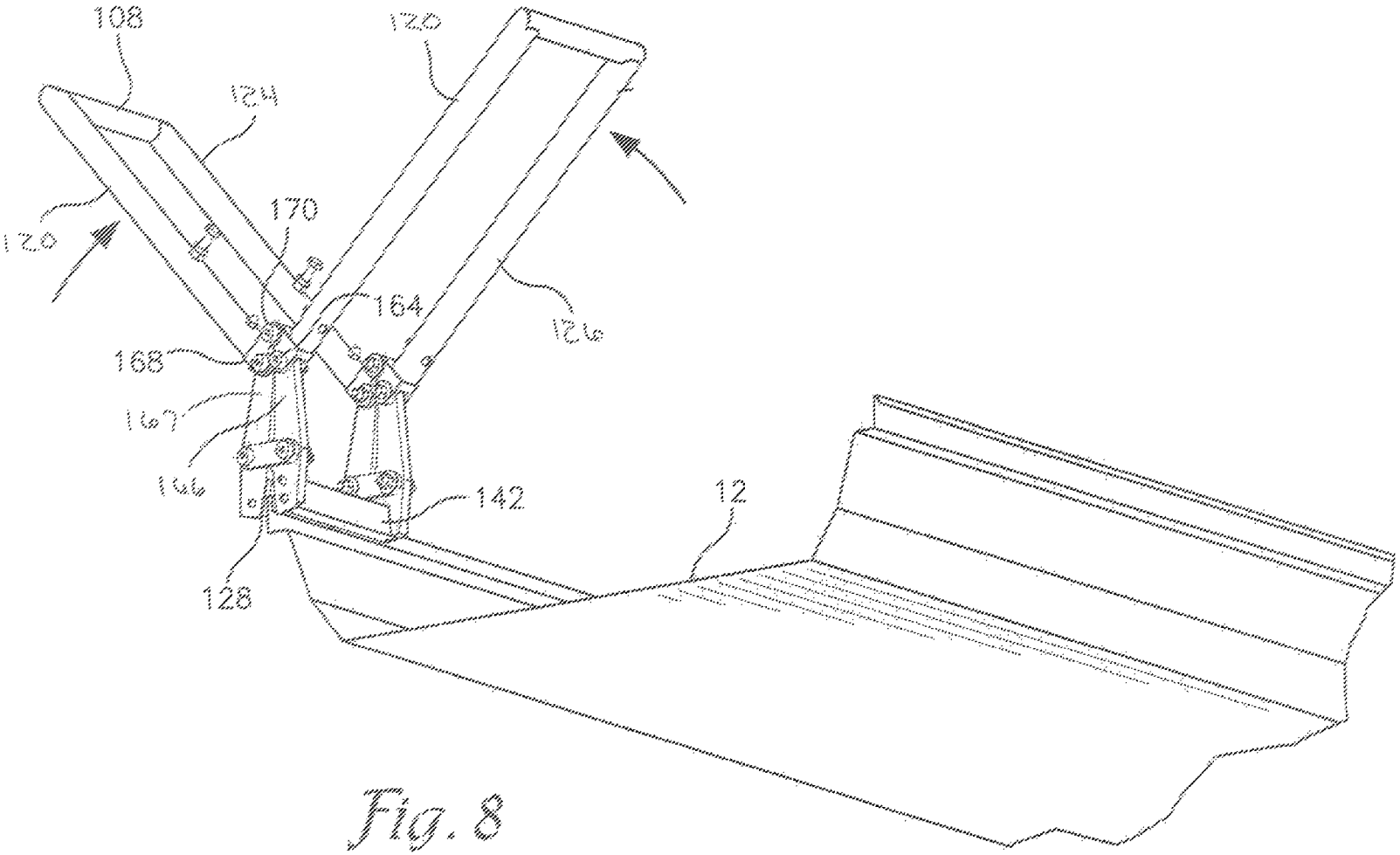
FIG. 8 a perspective view of an embodiment of the disclosed notching tool positioned upon a roof panel in preparation for severing the panel material.

In operation, as best seen in FIG. 8, the user places the female and male dies 128, 142 of the notching tool over the end of the roof panel 12 to be notched. Typically, the upslope edges of the panel 12 is where the excess material 24 is to be severed so that the panel 12 that is immediately above the panel being notched will overlap the downslope panel by the length of the notch. The length of the notch is generally about six inches, but may vary in length based upon roof design specifications.

The edge portion to be notched is positioned between the female and male dies 128, 142 and the operator of the notching tool applies pressure to the handle separation members 108, 110 in order to move them together as depicted by the arrows in FIG. 8. The force applied to the handle separation members is transferred along the handles 120, 122, 124, 126 to the major and minor rotation links 168, 164 of both the first and second mechanism assemblies 104, 106. As the separation members 108, 110 begin to move toward one another the major and minor rotation links 164, 168 rotate about the proximal ends 166, 167 of the first and second jaw bodies 134, 148 of both the first and second mechanism assemblies 104, 106.

As the major and minor rotation links 168, 164 are rotated about the proximal ends 166, 167 of the first and second jaw bodies 134, 148 of both the first and second mechanism assemblies 104, 106 the hinge 170 connecting the rotation links begins to rotate about the pin 172 passing through the knuckles 174 of the hinge 170. As the hinge 170 rotates toward the distal end of the jaw bodies 134, 148 this causes the proximal ends 166, 167 of the first and second jaw bodies of both the first and second mechanism assemblies 104, 106 to move away from one another. The movement away from one another by the proximal ends of the first and second jaw bodies occurs due to the placement of the fulcrum 182 against the inner side surface 190 of the opposing jaw body. With the continued movement of the handle separation members 108, 110 toward one another the proximal ends 166, 167 of the jaw bodies 134, 148 diverge from one another and the distal ends 132, 146 of the jaw bodies 134, 148 converge upon one another with rotation of the jaw bodies, relative to one another, taking place at the fulcrum 182.

The link plate 178 connecting the first and second jaw bodies on both the first and second mechanism assemblies 104, 106 maintains a consistent separation of the jaw bodies at the fulcrum 182. As the operator continues to press the handle separation members 108, 110 toward one another and the jaw bodies 134, 148 rotate about the fulcrum 182 the distal ends 132, 146 of the jaw bodies move toward one another. As the handles are moved closer together the overhang element 156 of the male die 142 will contact the roof panel 12. As additional pressure is applied to the handle separation members 108, 110, force is transferred to the jaw bodies and ultimately to the overhang element 156. With the application of sufficient force, the overhang element 156 severs the roof panel material at the desired location.

In an alternative embodiment, a first connecting rod extends between the minor rotation links of the first and second mechanism assemblies and a second connecting rod extends between the major rotation links of the first and second mechanism assemblies. Secured to and extending away from the midpoint of each of the first and second connecting rods are a single handle. This alternative embodiment is comprised of only two handles instead of four and also does not utilize two handle separation members. Consequently, the alternative embodiment with only two handles instead of four, is lighter and easier to transport. Operation of the two handled embodiment is similar to the four handled embodiment in terms of the convergence of the distal ends of the two handles that serves to create a convergence of the male and female dies in order to notch the metal roof panel. It is also contemplated that the male and female dies may be secured in the opposite orientation from one another as detailed above without substantially altering the operation of the roof panel notching tool.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and sub-combinations are of utility and may be employed without reference to other features and sub-combinations and are contemplated within the scope of the claims. Not all steps listed in the various figures need be carried out in the specific order described.

We claim:

1. A tool for field notching metal roof panels to allow the panels to properly nest within an end lap condition, the notching tool operable between open and closed positions, the notching tool comprising:

(a) first and second jaw bodies each with distal and proximal ends, the first and second jaw bodies separated by a fulcrum element wherein the first and second jaw bodies are secured to one another by a link plate disposed over the fulcrum element;

(b) third and fourth jaw bodies each with distal and proximal ends, the third and fourth jaw bodies separated by a fulcrum element wherein the third and fourth jaw bodies are secured to on another by a link plate disposed over the fulcrum element;

(c) a pivotal link secured to the proximal end of each of the jaw bodies wherein the pivotal links secured to the proximal ends of the first and second jaw bodies are linked together at a first pivoting knuckle and the pivotal links secured to the proximal ends of the third and fourth jaw bodies are linked together at a second pivoting knuckle;

(d) a handle secured to and extending outwardly from each of the pivotal links secured to the four jaw bodies;

(e) a female die extending between the distal ends of the first and third jaw bodies; and (f) a male die extending between the distal ends of the second and fourth jaw bodies, wherein when the male and female dies straddle the edge rib of a metal panel and the outwardly extending handles are moved toward one another by an operator, the dies sever the metal rib forming a notch.

2. A tool for field notching metal roof panels to allow the panels to properly nest within an end lap condition, the notching tool operable between open and closed positions, the notching tool comprising:

a first mechanism assembly, the first mechanism assembly further comprising first and second outwardly extending handles each with distal and proximal ends, the proximal end of the first outwardly extending handle secured to a major rotation link that is rotatably secured to a proximal end of a first jaw body, the proximal end of the second outwardly extending handle secured to a minor rotation link that is rotatably secured to a second jaw body, the minor and major links rotatably connected to one another at a hinge, the first and second jaw bodies further comprising distal ends, inner and outer facial surfaces, inner and outer side surfaces, wherein the first and second jaw bodies are joined together with at least one jaw link plate, the at least one jaw link plate disposed proximate a fulcrum extending outwardly from the inner side surface of the second jaw body, the fulcrum configured for engagement with the inner side surface of the first jaw body;

a second mechanism assembly configured similarly to and laterally separated from the first mechanism assembly by:

a) a female die secured to and extending transversely from the first mechanism assembly to the second mechanism assembly;

b) a male die secured to and extending transversely from the first mechanism assembly to the second mechanism assembly, the male die further comprising an overhang element to sever a portion of the roofing panel as the overhang element slides past the female die when the notching tool moves to a closed position;

c) a first handle separation member extending laterally between and secured to the distal ends of both the first outwardly extending handle of the first mechanism assembly and the distal end of the third outwardly extending handle of the second mechanism assembly; and d) a second handle separation member extending laterally between and secured to the distal ends of both the second outwardly extending handle of the first mechanism assembly and the distal end of the fourth outwardly extending handle of the second mechanism assembly.

3. The roof panel notching tool of claim 2, wherein the first mechanism assembly is separated from the second mechanism in the range of from 2 to 10 inches.

4. The roof panel notching tool of claim 2, wherein the at least one jaw link plate of the first and second mechanism assemblies is secured to the first and second jaw bodies in a manner that facilitates rotation of the first and second jaw bodies about the fulcrum as the notching tool operates between an open and a closed position.

5. The roof panel notching tool of claim 2, wherein the major rotation link further comprises a pair of knuckles adjacent the proximal end of the second jaw body and are secured in position with a cylindrical member that passes through the major rotation link knuckles and the proximal end of the second jaw body.

6. The roof panel notching tool of claim 2, wherein the overhang element severs the roofing panel as the overhang element slides past the female die when the notching tool moves to a closed position.

7. A tool for field notching metal roof panels to allow the panels to properly nest within an end lap condition, the notching tool comprising:

a first mechanism assembly, the first mechanism assembly further comprising first and second outwardly extending handles each with distal and proximal ends, the proximal end of the first outwardly extending handle secured to a surface of a major rotation link, the major rotation link rotatably secured to a proximal end of a first jaw body, the proximal end of the second outwardly extending handle secured to a surface of a minor rotation link that is rotatably secured to a second jaw body, the minor and major links rotatably connected at a hinge, the first and second jaw bodies further comprising distal ends, inner and outer facial surfaces, inner and outer side surfaces, wherein the first and second jaw bodies are joined together with at least one jaw link plate, the at least one jaw link plate disposed proximate a fulcrum extending outwardly from the inner side surface of the first jaw body, the fulcrum configured for engagement with a cutout in the inner side surface of the second jaw body;

a second mechanism assembly configured similarly to and laterally separated from the first mechanism assembly by:

a) a female die secured to and extending transversely from the first mechanism assembly to the second mechanism assembly;

b) a male die secured to and extending transversely from the first mechanism assembly to the second mechanism assembly, the male die further comprising an overhang element to sever a portion of the roofing panel as the overhang element slides past the female die when the notching tool moves to a closed position;

c) a first handle separation member extending laterally between and secured to the distal ends of both the first outwardly extending handle of the first mechanism assembly and the distal end of the third outwardly extending handle of the second mechanism assembly; and d) a second handle separation member extending laterally between and secured to the distal ends of both the second outwardly extending handle of the first mechanism assembly and the distal end of the fourth outwardly extending handle of the second mechanism assembly.

8. The roof panel notching tool of claim 7, wherein the at least one jaw link plate of the first and second mechanism assemblies is rotatably secured to the first and second jaw bodies in a manner that facilitates rotation of the first and second jaw bodies about the fulcrum as the notching tool operates between an open and a closed position.

9. The roof panel notching tool of claim 7, wherein the major rotation link further comprises a pair of knuckles adjacent the proximal end of the second jaw body and are secured in position with a cylindrical member that passes through the major rotation link knuckles and the proximal end of the second jaw body.

10. The roof panel notching tool of claim 7, wherein the overhang element to sever the roofing panel as the overhang element slides past the female die when the notching tool moves to a closed position.

11. A tool for field notching metal roof panels to allow the panels to properly nest within an end lap condition, the notching tool operable between an open and closed position, the notching tool comprising:

(a) a first jaw body with a proximal and a distal end, inner and outer facial surfaces, inner and outer side surfaces, a first fulcrum extending outwardly from the inner side surface of the first jaw body proximate the distal end;

(b) a second jaw body with a proximal and a distal end, inner and outer facial surfaces and inner and outer side surfaces, the first and second jaw bodies secured opposite one another by a first jaw link plate disposed atop the outer facial surfaces of both the first and second jaw bodies and disposed over the area of engagement between the first fulcrum and the inner side surface of the second jaw body;

(c) a third jaw body with a proximal and a distal end, inner and outer facial surfaces and inner and outer side surfaces, inner and outer facial surfaces, inner and outer side surfaces, a second fulcrum extending outwardly from the inner side surface of the third jaw body proximate the distal end;

(d) fourth jaw body with a proximal and a distal end, inner and outer facial surfaces and inner and outer side surfaces, the third and fourth jaw bodies secured opposite one another by a first jaw link plate disposed atop the outer facial surfaces of both the third and fourth jaw bodies and disposed over the area of engagement between the second fulcrum and the inner side surface of the fourth jaw body;

(e) a first minor rotation link with a first end pivotally secured to the proximal end of the first jaw body and a second end with at least one hinge knuckle;

(f) a first major rotation link with a first end pivotally secured to the proximal end of the second jaw body and a second end with at least one hinge knuckle operably engaged with the at least one hinge knuckle of the first minor rotation link;

(g) a second minor rotation link with a first end pivotally secured to the proximal end of the third jaw body and a second end with at least one hinge knuckle;

(h) a second major rotation link with a first end pivotally secured to the proximal end of the fourth jaw body and a second end with at least one hinge knuckle operably engaged with the at least one hinge knuckle of the second minor rotation link;

(i) a female die extending between the inner side surfaces of the distal ends of the first and third jaw bodies, the male die further comprising an overhang element;

(j) a male die configured for operable engagement with the overhang element of the male die, the male die extending between the inner side surfaces of the distal ends of the second and fourth jaw bodies;

(k) a first outwardly extending handle with a distal and a proximal end, the proximal end of the handle secured to the first minor rotation link;

(l) a second outwardly extending handle with a distal and a proximal end, the proximal end of the handle secured to the first major rotation link;

(m) a third outwardly extending handle with a distal and a proximal end, the proximal end of the handle secured to the second minor rotation link;

(n) a fourth outwardly extending handle with a distal and a proximal end, the proximal end of the handle secured to the second major rotation link;

(o) a first handle separation member disposed between the distal ends of the first and third outwardly extending handles; and (p) a second handle separation member disposed between the distal ends of the second and fourth outwardly extending handles;

wherein in operation a user positions the male and female dies on opposite sides of a roof panel rib to be notched and presses the first and second handle separation members together thereby causing the proximal ends of the first and second jaw bodies to move away from one another and the proximal ends of the third and fourth jaw bodies to move away from one another while the distal ends of the first and second jaw bodies move toward one another and the distal ends of the third and fourth jaw bodies move toward one another due to rotation of the first and second jaw bodies about the first fulcrum and the rotation of the third and fourth jaw bodies about the second fulcrum.

12. A tool for field notching metal roof panels to allow the panels to properly nest within an end lap condition, the notching tool operable between an open and closed position, the notching tool comprising:

(a) a first jaw body with a proximal and a distal end, inner and outer facial surfaces, inner and outer side surfaces, a first fulcrum extending outwardly from the inner side surface of the first jaw body proximate the distal end;

(b) a second jaw body with a proximal and a distal end, inner and outer facial surfaces and inner and outer side surfaces, the first and second jaw bodies secured opposite one another by a first jaw link plate disposed atop the outer facial surfaces of both the first and second jaw bodies and disposed over the area of engagement between the first fulcrum and the inner side surface of the second jaw body;

(c) a third jaw body with a proximal and a distal end, inner and outer facial surfaces and inner and outer side surfaces, inner and outer facial surfaces, inner and outer side surfaces, a second fulcrum extending outwardly from the inner side surface of the third jaw body proximate the distal end;

(d) fourth jaw body with a proximal and a distal end, inner and outer facial surfaces and inner and outer side surfaces, the third and fourth jaw bodies secured opposite one another by a first jaw link plate disposed atop the outer facial surfaces of both the third and fourth jaw bodies and disposed over the area of engagement between the second fulcrum and the inner side surface of the fourth jaw body;

(e) a first minor rotation link with a first end pivotally secured to the proximal end of the first jaw body and a second end with at least one hinge knuckle;

(f) a first major rotation link with a first end pivotally secured to the proximal end of the second jaw body and a second end with at least one hinge knuckle operably engaged with the at least one hinge knuckle of the first minor rotation link;

(g) a second minor rotation link with a first end pivotally secured to the proximal end of the third jaw body and a second end with at least one hinge knuckle;

(h) a second major rotation link with a first end pivotally secured to the proximal end of the fourth jaw body and a second end with at least one hinge knuckle operably engaged with the at least one hinge knuckle of the second minor rotation link;

(i) a male die extending between the inner side surfaces of the distal ends of the first and third jaw bodies, the male die further comprising an overhang element;

(j) a female die configured for operable engagement with the overhang element of the male die, the female die extending between the inner side surfaces of the distal ends of the second and fourth jaw bodies;

(k) a first outwardly extending handle with a distal and a proximal end, the proximal end of the handle secured to a connecting link disposed between both the first minor rotation link and the first major rotation link;

(l) a second outwardly extending handle with a distal and a proximal end, the proximal end of the handle secured to a connecting link disposed between both the second minor rotation link and the second major rotation link;

wherein in operation a user positions the male and female dies on opposite sides of a roof panel rib to be notched and presses the first and second outwardly extending handle members together thereby causing the proximal ends of the first and second jaw bodies to move away from one another and the proximal ends of the third and fourth jaw bodies to move away from one another while the distal ends of the first and second jaw bodies move toward one another and the distal ends of the third and fourth jaw bodies move toward one another due to rotation of the first and second jaw bodies about the first fulcrum and the rotation of the third and fourth jaw bodies about the second fulcrum.

* * * * *